United States Patent [19]

Mott

[11] Patent Number: 4,517,877

[45] Date of Patent: May 21, 1985

[54] STEP CONTROL APPARATUS FOR A FLUID MOTOR

[75] Inventor: Philip J. Mott, Des Plaines, Ill.

[73] Assignee: Borg-Warner Corporation, Chicago, Ill.

[21] Appl. No.: 463,352

[22] Filed: Feb. 2, 1983

[51] Int. Cl.[3] ..... F15B 9/09

[52] U.S. Cl. ..... 91/48; 91/368; 91/357; 91/445; 91/449; 137/596.17

[58] Field of Search ..... 91/48, 368, 445, 449, 91/357, 402; 137/596.17

[56] References Cited

U.S. PATENT DOCUMENTS

| | | | |
|---|---|---|---|
| 2,508,399 | 5/1950 | Kendrick | 91/445 X |
| 3,411,413 | 11/1968 | MacNeill et al. | 91/357 |
| 3,457,836 | 7/1969 | Henderson | 91/368 X |
| 3,732,027 | 5/1973 | Lupke et al. | 91/445 X |
| 3,945,299 | 3/1976 | Fritz et al. | 91/31 |
| 4,014,248 | 3/1977 | Cyrot | 91/445 X |
| 4,114,513 | 9/1978 | Debrus | 91/445 X |
| 4,311,083 | 1/1982 | Guillon | 91/19 |

FOREIGN PATENT DOCUMENTS

| | | | |
|---|---|---|---|
| 2050417 | 4/1972 | Fed. Rep. of Germany | 91/357 |
| 2338425 | 2/1975 | Fed. Rep. of Germany | 91/357 |
| 2345146 | 3/1975 | Fed. Rep. of Germany | 91/368 |
| 0417636 | 8/1974 | U.S.S.R. | 91/445 |
| 0576441 | 10/1977 | U.S.S.R. | 91/445 |
| 0756086 | 8/1980 | U.S.S.R. | 91/445 |

OTHER PUBLICATIONS

*Take a Fresh Look at Motion Control*, published by Motion Products Division, MTS Systems Corporation, Minneapolis, MN.

*Primary Examiner*—Robert E. Garrett
*Assistant Examiner*—Richard S. Meyer
*Attorney, Agent, or Firm*—Julian Schachner

[57] ABSTRACT

Step control apparatus for a fluid motor includes a plurality of devices each responsive to an external signal for initiating movement of the fluid motor. Also included is a mechanism for stopping movement of the fluid motor upon movement thereof a discrete step. Thus, a sequence of external signals applied to the devices effects movement of the fluid motor in a stepping mode. Optionally, an assembly may be provided for effecting movement of the fluid motor in a free-running mode.

6 Claims, 3 Drawing Figures

Fig. 2.
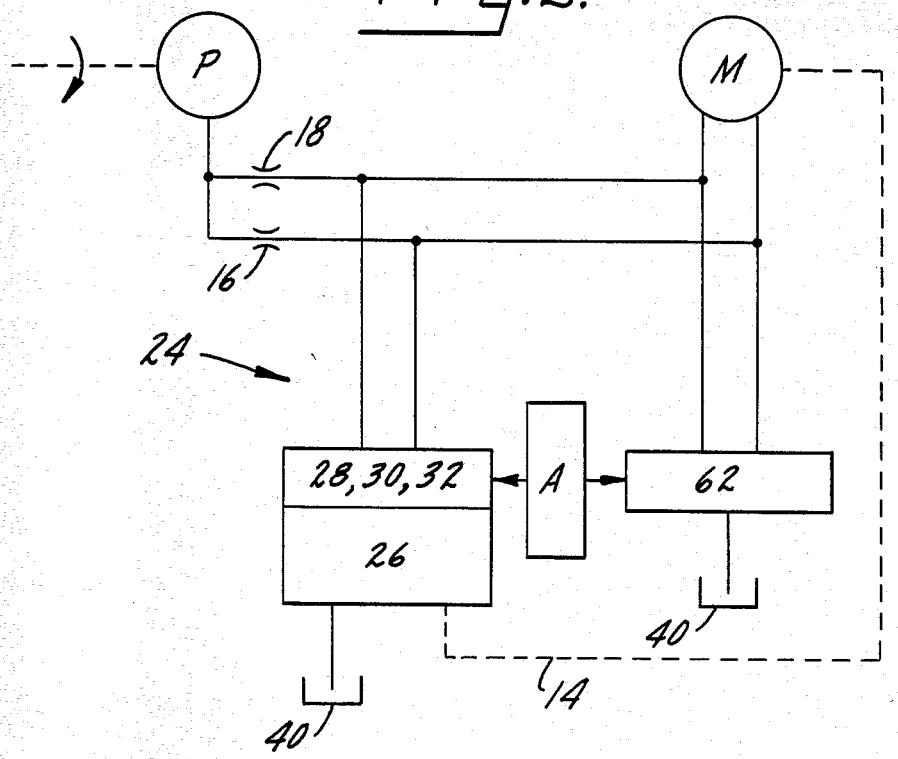
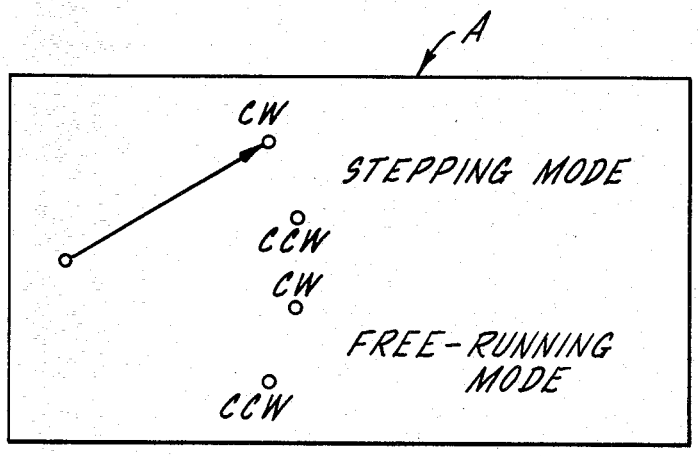
Fig. 3.

STEP CONTROL APPARATUS FOR A FLUID MOTOR

BACKGROUND OF THE INVENTION

This invention relates generally to the control of a fluid motor. More particularly, it relates to apparatus for controlling a fluid motor such that it steps in discrete increments while maintaining a significant holding torque.

A step motor basically is an electromagnetic DC motor rotatable in discrete steps or increments which may be controlled precisely. One need only keep track of the number and direction of steps taken in order to know the position of the rotor at all times. There are many applications where precise control is needed, and thus where the use of a step motor would be desirable.

For reasons of economy, the typical step motor has a low torque capability. Thus, in applications where precise control would be desirable but where high torque capacity is required, the step motor generally is not used.

A conventional fluid motor may have a high torque capability, and often is used in applications having heavy load characteristics. However, the conventional fluid motor generally is free-running, and is not capable of stepping in discrete increments. There is a need in the art for some type of control apparatus which will enable a conventional fluid motor to step in discrete increments.

SUMMARY OF THE INVENTION

The object of this invention is to meet this need. To that end, there is disclosed step control apparatus for use with a conventional fluid motor, which apparatus enables the motor to step in discrete increments.

In summary, this invention is directed to step control apparatus for a fluid motor having first and second motor ports communicating with a source of fluid under pressure. The step control apparatus comprises a control mechanism including a chamber adapted to communicate with a fluid reservoir, a plurality of pairs of control ports, each pair having first and second ports communicating with the chamber, and a control member in the chamber. The control member is movable in response to movement of the motor to a plurality of equilibrium positions in which both control ports of a selected pair are in communication with the chamber, and in which one control port of at least one of the remaining pairs is blocked from communication with the chamber.

The step control apparatus also comprises a plurality of valve devices each associated with a pair of control ports. Each device is actuatable to communicate the first and second motor ports respectively with the first and second control ports of its associated pair.

The step control apparatus is so constructed and arranged that sequential actuation of the devices effects movement of the motor in a stepping mode.

The step control apparatus further comprises a valve assembly associated with the motor ports. The assembly is actuatable to communicate the motor ports with the reservoir. When actuated, the assembly effects movement of the motor in a free-running mode.

BRIEF DESCRIPTION OF THE DRAWINGS

The objects and advantages of this invention will become apparent to those skilled in the art upon careful consideration of the specification herein, including the drawings, in which:

FIG. 2 is a diagramatic view showing additional details of the step control apparatus; and FIG. 3 is a symbolic view of actuating means for the step control apparatus.

Figure 1:
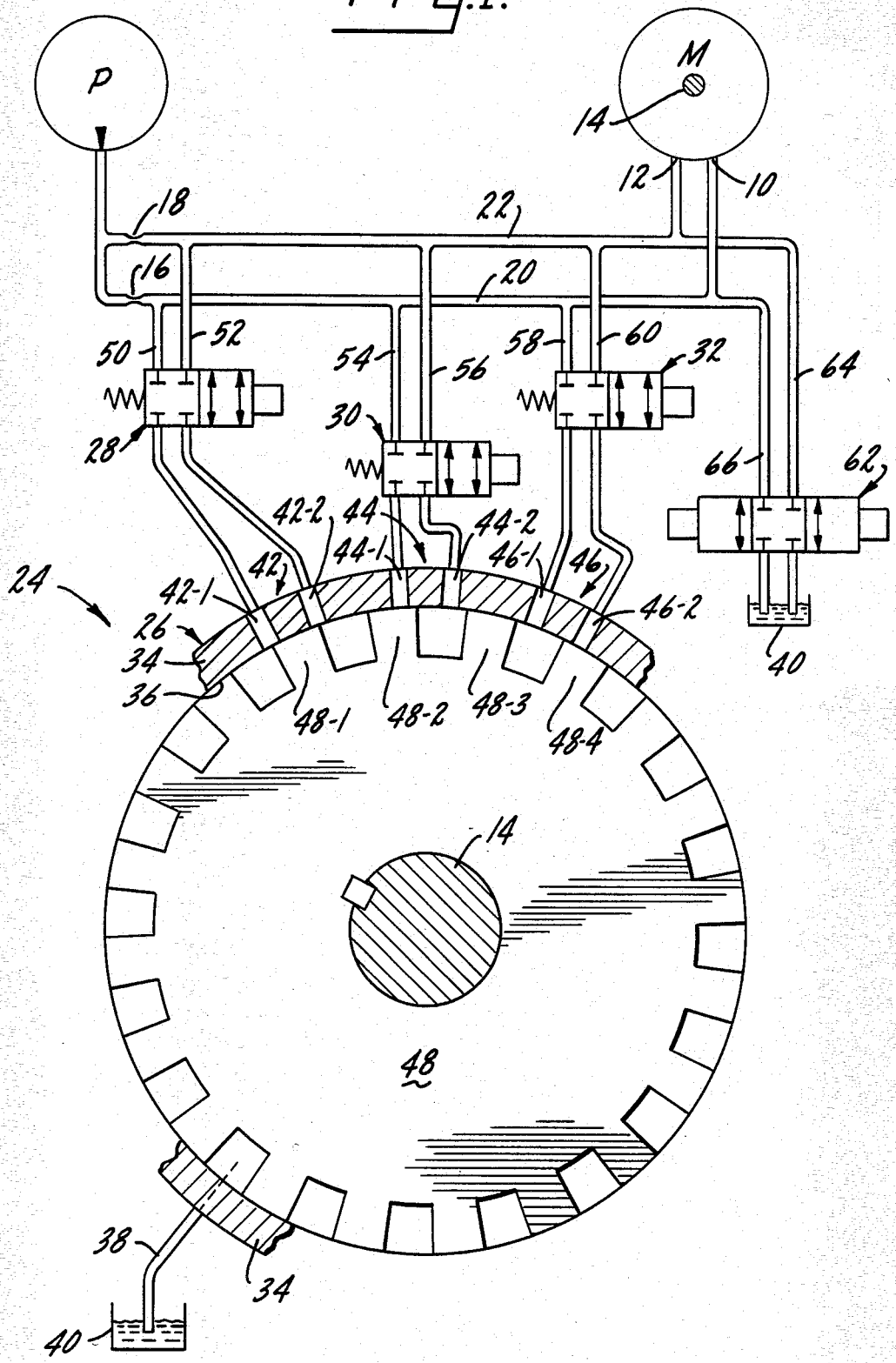
FIG. 1 is a diagramatic view showing details of the step control apparatus.

While this invention is susceptible of embodiment in many different forms, the preferred embodiment is shown in the drawings and described in detail. It should be understood that the present disclosure is considered to be an exemplification of the principles of the invention, and is not intended to limit the invention to this embodiment.

DESCRIPTION OF THE PREFERRED EMBODIMENT

Turning now to the drawings in greater detail, reference character M designates a conventional fluid motor. In the preferred form of the invention, motor M is a vane-type hydraulic motor. However, it should be understood that the invention is applicable to other types of fluid motors as well.

In a conventional manner, motor M is provided with a first, clockwise (cw) rotation motor port 10 and a second, counterclockwise (ccw) rotation motor port 12. Fluid pressure directed selectively to these motor ports will rotate motor M in one direction or the other. Motor M also includes a rotor 14.

A conventional pump P is in communication with motor ports 10 and 12 respectively through flow restricters 16 and 18 and fluid lines 20 and 22. When pump pressure is applied to both motor ports 10 and 12, motor M remains stationary. When this pressure is relieved from one motor port but remains applied to the other, motor M rotates in a free-running mode.

Motor M may be controlled such that it rotates in a stepping mode; that is, in discrete steps or increments. Step control apparatus 24 includes a control mechanism 26 and a plurality of solenoid valve devices 28, 30 and 32. In the preferred form of the invention, there are three such valve devices.

Control mechanism 26 includes a housing 34 defining a control chamber 36. A suitable fluid line 38 communicates chamber 36 with a fluid reservoir or sump 40.

Housing 34 also defines a plurality of spaced pairs of control ports 42, 44 and 46, each having a first control port 1 and a second control port 2. In the preferred form of the invention, there are three such pairs of control ports.

Control mechanism 24 also includes a control member 48 defining a plurality of teeth 48-1, 48-2, 48-3, 48-4 etc. As shown in the drawing, control member 48 defines twenty such teeth, although the exact number is a design feature.

Control member 48 is rotatable in response to rotation of rotor 14. In the preferred form of the invention, control member 48 is mounted directly on rotor 14, although it may be coupled thereto by a suitable gear train or the like.

First solenoid valve device 28 may be actuated to establish fluid communication between motor ports 10 and 12 and control ports 42-1 and 42-2 respectively through fluid lines 20 and 22 and fluid lines 50 and 52. Second solenoid valve device 30 may be actuated to establish fluid communication between motor ports 10 and 12 and control ports 44-1 and 44-2 respectively through fluid lines 20 and 22 and fluid lines 54 and 56. Similarly, third solenoid valve device 32 may be actuated to establish fluid communication between motor ports 10 and 12 and control ports 46-1 and 46-2 respectively through fluid lines 20 and 22 and fluid lines 58 and 60. Thus, when any one of the valve devices is actuated, its associated pair of control ports are rendered active; that is, they are placed in fluid communication with motor ports 10 and 12.

When valve device 28 is actuated, motor ports 10 and 12 are placed in fluid communication with active control ports 42-1 and 42-2. A condition of equilibrium is reached when a tooth, for example tooth 48-1, is centered between these two control ports so as to communicate both of them with chamber 36. Both motor ports 10 and 12 drain to reservoir 40 through these two control ports, chamber 36 and fluid line 38. Motor M remains stationary.

When tooth 48-1 is in its equilibrium position, tooth 48-2 is in a position which blocks first control port 44-1 of pair 44. Similarly, tooth 48-4 is in a position which blocks second control port 46-2 of pair 46.

Assuming that clockwise rotation in the stepping mode is desired, valve device 28 is de-actuated and valve device 30 is actuated, rendering control ports 44-1 and 44-2 active. Control port 44-1 is blocked by tooth 48-2, but motor port 12 will drain through lines 22 and 56 and valve device 30 to control port 44-2, chamber 36 and reservoir 40. Pump pressure will be directed through line 20 to motor port 10 such that clockwise rotation of motor M is initiated. Motor M will rotate one step; that is, until tooth 48-2 reaches its equilibrium position relative to control ports 44-1 and 44-2. This new equilibrium position will be reached when tooth 48-2 is centered between these two control ports, communicating both of them with chamber 36 and reservoir 40. Thus, motor M stops after having rotated one step. In this new equilibrium position, tooth 48-1 blocks second control port 42-2, and tooth 48-3 blocks first control port 46-1.

The sequence is continued when valve device 30 is de-actuated and valve device 32 is actuated, rendering control ports 46-1 and 46-2 active. Control port 46-1 is blocked by tooth 48-3, but control port 46-2 is not blocked. Pump pressure will be applied to motor port 10, and motor port 12 will drain to reservoir 40. Motor M will rotate another step in the clockwise direction.

Thus, stepped clockwise rotation of motor M may be obtained by actuating the valve devices in the sequence 28, 30, 32, 28, 30, 32 etc. Obviously, stepped counterclockwise rotation of motor M may be obtained by actuating the valve devices in the sequence 32, 30, 28, 32, 30, 28 etc. By selectively actuating the valve devices in one sequence or the other, the motor will rotate in the stepping mode.

If desired, an actuating means A, for example an electronic circuit of suitable design, may be switched to the stepping mode in order to provide external signals in the form of digital pulses or the like for actuating the valve devices. Actuation may be in the form of a single pulse to inch motor M a single step, or a series of pulses in whatever number and sequence may be desired to rotate motor M a series of steps.

As an optional feature, step control apparatus 24 may include a solenoid valve assembly 62. If desired, actuating means A may be switched to the free-running mode in order to provide external signals for actuating this valve assembly.

When valve assembly 62 is actuated, it will shift in one direction or the other, allowing motor M to rotate in the free-running mode. For example, if valve 62 is shifted to the left, motor port 12 will drain through a fluid line 64 to reservoir 40. Pump pressure applied to motor port 10 will rotate motor M in the clockwise direction without regard to the position of control member 48. Similarly, if valve assembly 62 is shifted to the right, motor port 10 will drain through a fluid line 66 to reservoir 40. Pump pressure applied to motor port 12 will rotate motor M in the counterclockwise direction without regard to the position of control member 48.

The stepping mode is established by selectively actuating valve devices 28, 30 and 32 either in a 28, 30, 32 sequence for clockwise rotation of motor M, or in a 32, 30, 28 sequence for counterclockwise rotation of motor M. In either case, rotation will be in steps which may be precisely controlled. The free-running mode is established by selectively actuating valve assembly 62.

A hydraulic motor typically has a higher torque capability than an electromagnetic step motor. The step control apparatus of this invention may be used to operate a conventional hydraulic motor in a stepping mode. Thus, the hydraulic motor may be used in applications where high torque loading is encountered. For a given torque range, the hydraulic motor would be smaller, more efficient and easier to control than the electromagnetic step motor.

It should be understood that while the preferred embodiment of this invention has been shown and described, it is considered to be illustrative and may be modified by those skilled in the art. It is intended that the claims herein cover all such modifications as may fall within the spirit and scope of the invention.

What is claimed is:

1. Step control apparatus for a fluid motor having first and second motor ports communicating with a source of fluid under pressure, said step control apparatus comprising a control mechanism including a chamber adapted to communicate with a fluid reservoir, three pairs of control ports, each pair having first and second control ports for communicating with said chamber, a control member movable in said chamber, and means for moving said control member in response to movement of said motor, said control member including a plurality of control teeth each of which has an equilibrium position communicating both control ports of a selected pair with said chamber, another position blocking said first control port of one of the remaining pairs, and yet another position blocking said second control port of the other of the remaining pairs, one of said teeth communicating both control ports of said selected pair with said chamber when in its equilibrium position, and two others of said teeth blocking respectively said first and second control ports of the other two remaining pairs when said one tooth is in its equilibrium position, and said step control apparatus also comprising three valve devices each of which is associated with a pair of said control ports, each valve device being actuatable to communicate said first and second motor ports respectively with said first and second control ports of its associated pair, whereby actuation of said valve devices effects movement of said motor in a stepping mode.

2. The step control apparatus of claim 1, further comprising a valve assembly associated with said motor ports, said valve assembly being actuatable to communicate one of said motor ports with said reservoir, whereby actuation of said valve assembly effects movement of said motor in a free-running mode.

3. The step control apparatus of claim 1 wherein the fluid motor is a rotary fluid motor, the first motor port is connected to effect clockwise rotation of the motor, and the second motor port is connected to effect counterclockwise rotation of the motor, said control member being rotatable in said chamber in response to rotation of said motor.

4. The step control apparatus of claim 2, wherein the fluid motor is a rotary fluid motor, the first motor port is connected to effect clockwise rotation of the motor, and the second motor port is connected to effect counterclockwise rotation of the motor, said control member being rotatable in said chamber in response to rotation of said motor.

5. The step control apparatus of claim 1, further comprising means for actuating said valve devices.

6. The step control apparatus of claim 2, further comprising means for actuating said valve devices.

* * * * *